US009364695B2

(12) United States Patent
Chantelois et al.

(10) Patent No.: US 9,364,695 B2
(45) Date of Patent: Jun. 14, 2016

(54) TROLLEY COMPRISING A FALL ARREST ACTUATOR

(71) Applicant: PROCHUTE SECURITE INC., St-Lambert, Quebec (CA)

(72) Inventors: Annie Chantelois, St-Lambert (CA); Frederick Labbe, St-Hubert (CA)

(73) Assignee: Prochute Securite Inc., St-Lambert, Quebec (CA)

( * ) Notice: Subject to any disclaimer, the term of this patent is extended or adjusted under 35 U.S.C. 154(b) by 117 days.

(21) Appl. No.: 14/352,416

(22) PCT Filed: Oct. 19, 2012

(86) PCT No.: PCT/CA2012/000967

§ 371 (c)(1),
(2) Date: Apr. 17, 2014

(87) PCT Pub. No.: WO2013/056353

PCT Pub. Date: Apr. 25, 2013

(65) Prior Publication Data

US 2014/0284150 A1 Sep. 25, 2014

Related U.S. Application Data

(60) Provisional application No. 61/549,381, filed on Oct. 20, 2011.

(51) Int. Cl.

| | |
|---|---|
| ***B65H 59/10*** | (2006.01) |
| ***A62B 1/14*** | (2006.01) |
| ***A62B 35/00*** | (2006.01) |
| ***E04G 21/32*** | (2006.01) |

(52) U.S. Cl.

CPC ..... *A62B 35/0081* (2013.01); *E04G 21/3204* (2013.01); *E04G 21/3276* (2013.01); *E04G 21/3295* (2013.01); *A62B 1/14* (2013.01)

(58) Field of Classification Search

CPC ..... A62B 1/14; A62B 35/0081

USPC ..... 188/65.1, 65.2

See application file for complete search history.

(56) References Cited

U.S. PATENT DOCUMENTS

| | | | | |
|---|---|---|---|---|
| 4,083,438 | A * | 4/1978 | Handa | 188/65.3 |
| 5,265,696 | A * | 11/1993 | Casebolt | 182/8 |
| 2003/0029672 | A1* | 2/2003 | Argoud | 182/36 |
| 2011/0232997 | A1* | 9/2011 | Wang | 182/133 |

FOREIGN PATENT DOCUMENTS

| | | | |
|---|---|---|---|
| WO | 0024471 | A1 | 5/2000 |
| WO | 2005044383 | A1 | 5/2005 |

* cited by examiner

*Primary Examiner* — Thomas J Williams

(74) *Attorney, Agent, or Firm* — Fraser Clemens Martin & Miller LLC; James D. Miller

(57) ABSTRACT

The trolley is used in a fall arrest system and comprises a frame, a channel formed within the frame for engagement therein of a lifeline, and a self-blocking mechanism carried by the frame. The self-blocking mechanism comprises a brake movable between a braking position wherein the brake extends within the channel for frictionally engaging the lifeline; and an enabling position wherein the brake clears the channel for clearing the lifeline. The self-blocking mechanism also comprises a manually operable enabling actuator connected to the brake and capable of forcing the brake towards the enabling position. The self-blocking actuator further comprises a fall arrest actuator distinct from the brake and from the enabling actuator, and connected to the brake, the fall arrest actuator being movable with respect to the frame in a direction transversal to the channel between a fall position wherein the fall arrest actuator forces the brake towards the braking position and an idle position wherein the fall arrest actuator does not force the brake towards the braking position, with the fall arrest actuator capable of overriding the enabling actuator to force the brake towards the braking position.

26 Claims, 7 Drawing Sheets

TROLLEY COMPRISING A FALL ARREST ACTUATOR

CROSS-REFERENCE DATA

The present application claims the priority under the Paris Convention of U.S. provisional patent application No. 61/549,381 filed on Oct. 20, 2011.

FIELD OF THE INVENTION

The present invention relates to fall arrest systems, and more particularly to a trolley used in a fall arrest system to allow a user to attach himself to a lifeline with his lanyard, with the trolley allowing movement along the lifeline when the user walks on a structure that carries the lifeline while stopping movement along the lifeline if the user falls.

BACKGROUND OF THE INVENTION

It is known for a worker required to stand and move along a structure located spacedly over ground to use a fall arrest system to avoid falling to the ground. The structure may be, for example, a space frame truss located high over ground in a construction site, theatre, factory, storage facility, outdoor bridge or the like; a scaffolding erected about a structure being constructed or repaired; or an existing structure such as a building or bridge along which the worker is required to move.

Known fall arrest systems comprise a lifeline running along the structure on which the worker will move. The lifeline is an elongated support element that can be flexible such as a cable or wire, or rigid such as a rail. The fall arrest systems also comprise a harness that the worker equips, linked to a carabiner by means of a lanyard. The carabiner consists of a closed loop rigid rod with one segment thereof being a spring catch, to allow easy attachment to the lifeline. However, direct attachment of the carabiner to the lifeline means that if the worker falls off the structure on which he is standing, although he will be prevented from falling to the ground beyond the length of his lanyard due to attachment to the lifeline, he can still be undesirably dragged under his own weight to one side or the other along the lifeline if the latter is inclined or sags. Such a situation may result in the worker being injured even if his fall to the ground is prevented.

The prior art discloses some carriages, or trolleys, that may be used as part of the fall arrest systems. The purpose of these trolleys is to slide or roll along the lifeline when the worker desires to move along it, but to lock or brake against the lifeline if the worker falls, to arrest this fall. The worker attaches himself with his carabiner to the trolley. They prior art trolleys known to the inventors fall into two categories: those for use along vertical cables and those for use along inclined cables. Inclined cables, as the name suggests, are those that are neither horizontal nor vertical.

Prior art trolleys for use along vertical cables or rails are used by workers that move vertically along a structure. These trolleys come in different designs and shapes, but have a common feature: it is upon the weight of the worker falling downwards, parallel to the vertical cable, that the trolley fall arrest mechanism will be activated. Many such trolleys include a cam pivotable on a frame of the trolley, with the cam having a serrated braking edge that will engage the cable or rail when biased by the weight of the falling worker. The fall arrest systems of these trolleys are unidirectional in that they are intended to be activated only in a single direction and pivoting the cam in the opposite direction will not result in any braking action—on the contrary, pivoting the cam in the opposite direction is usually accomplished to disable the cam's braking action to allow the worker to move along the cable or rail. The unidirectional quality of fall arrest systems of trolleys usable along vertical cables is to be expected since the fall may of course only occur in a single direction on vertical cables, namely along the cable.

Prior art trolleys for use along inclined cables or rails are used by workers that work on inclined surfaces such as roofs. These trolleys also have a common feature: many include a pair of cams that will allow the braking action to occur when the user falls along the inclined surface being worked on. That is to say, these trolleys are also activated upon the worker falling parallel to the lifeline. Some of these trolleys are bidirectional in that they are intended to be activated in either one of two directions, both of them parallel to the lifeline. This is why they are provided with two cams instead of a single one. This way, if a worker works on both opposite sides of an inclined roof, he may cross over from one side that is inclined in a first direction to the other that is inclined in the other direction along a single lifeline, and his fall arrest system will remain operable at any point of his travel.

No prior art trolley however is intended for use on an inclined lifeline such that the fall arrest system will be activated when a user falls transversally away from the lifeline. This may occur for example if the user works along a structure where an inclined lifeline is installed, i.e. where the cable supports are vertically offset, however without having a correspondingly inclined structure underfoot. For example, if the lifeline extends along a space frame truss that is itself inclined, then the user may fall vertically downwards at any point along the space frame truss between or besides the truss members. This is different from workers working on roofs where a vertical fall won't occur: a worker may accidentally slide along the roof and it is this sliding that must be arrested, parallel to the roof and parallel to the lifeline. However the worker will not fall "through" the roof.

Another feature of many prior art trolleys, both the ones for use along vertical lifelines and the ones for use along horizontal lifelines, is a biasing member, usually a spring, that continuously forces the braking device into a default braking position. This prevents the trolley from moving along the lifeline when the user releases it. To move the trolley along the lifeline, the worker must enable this movement by disabling the brake. This is accomplished by manually pulling on the cam or other brake member to force it away from its braking position against the bias of the spring. However, an important problem can, and sometimes does, result when a fall occurs while the worker is disabling the braking device to move: in his fall, the worker does not think to release the braking device, and the trolley, free to move along the lifeline, follows the worker in his fall. It should be noted that when falling, many workers will have a reflex to contract their muscles under the sudden stress of the event, and consequently not releasing the braking device held in a disabled position is far from improbable.

SUMMARY OF THE INVENTION

The present invention relates to a trolley for use in a fall arrest system, said trolley comprising a frame, a channel formed within said frame for engagement therein of a lifeline, and a self-blocking mechanism carried by said frame, said self-blocking mechanism comprising:

a brake movable between a braking position wherein said brake extends within said channel for frictionally engaging the lifeline; and an enabling position wherein said brake clears said channel for clearing the lifeline;

a manually operable enabling actuator connected to said brake and capable of forcing said brake towards said enabling position; and a fall arrest actuator distinct from said brake and from said enabling actuator, and connected to said brake, said fall arrest actuator being movable with respect to said frame between a fall position wherein said fall arrest actuator forces said brake towards said braking position and an idle position wherein said fall arrest actuator does not force said brake towards said braking position, with said fall arrest actuator capable of overriding said enabling actuator to force said brake towards said braking position.

In one embodiment, said self-blocking mechanism comprises a biasing member continuously biasing said brake towards said braking position, said enabling actuator capable of overriding said biasing member to force said brake towards said enabling position.

In one embodiment, said biasing member comprises a spring tensioned between said enabling actuator and said frame, with said spring continuously biasing said brake towards said braking position through the instrumentality of said enabling actuator.

In one embodiment, said self-blocking mechanism comprises a cam pivotally carried by said frame, with said brake, said enabling actuator and said fall arrest actuator all pivotally attached to said cam.

In one embodiment, said brake comprises a piston movable in translation within said frame between said braking and enabling positions.

In one embodiment, said enabling actuator comprises a trigger pivotally carried by said frame and pivotally linked to said cam.

In one embodiment, said fall arrest actuator comprises an actuating arm pivotally attached to said cam at a first end and comprising a user connector at a second end for attachment to a user carabiner and lanyard, said actuating arm being movable at least partly in translation with respect to said frame between said fall and idle positions.

In one embodiment, said user connector comprises a ring for attachment to the carabiner and lanyard, with said frame comprising a carabiner opening wherein said ring is located for allowing the carabiner to concurrently engage said actuating arm ring and said carabiner opening.

In one embodiment, said frame comprises first and second frame portions movable with respect to each other between an opened position wherein transversal access to said channel is allowed for allowing access and egress of the lifeline therein, and a closed position wherein transversal access to said channel is not allowed for preventing access or egress of the lifeline to or from said channel.

In one embodiment, said enabling actuator comprises a trigger pivotally carried by said frame and pivotally linked to said cam, with said frame comprising a casing generally enclosing said self-blocking mechanism, with said channel extending through said casing, with said user connector being accessible outside of said casing and with said trigger being pivotally connected to said casing within said casing and extending outside of said casing.

In one embodiment, said trolley further comprises a lock capable of locking said frame first and second portions in their closed position, said lock comprising said carabiner opening that extends through both said frame first and second portions for allowing the carabiner to extend around said frame first and second portions and through said carabiner opening thereby locking said frame first and second portions.

In one embodiment, said lock further comprises a locking clip carried by said frame and movable between a locked position wherein said locking clip maintains said frame first and second portions in said closed position and an unlocked position wherein said locking clip releases said frame first and second portions.

In one embodiment, said locking clip comprises an additional carabiner opening for releasable engagement therein of the carabiner when said locking clip is in said locked position for preventing movement of said locking clip from said locked position to said unlocked position.

In one embodiment, said fall arrest actuator is movable with respect to said frame in a direction transversal to said channel between said fall position that is located away from said channel and said idle position that is located towards said channel.

In one embodiment, said fall arrest actuator is movable with respect to said frame in a direction perpendicular to said channel between said fall position that is located away from said channel and said idle position that is located towards said channel.

The present invention also relates to a trolley for use in a fall arrest system, said trolley comprising a frame, a channel formed within said frame for engagement therein of a lifeline, and a self-blocking mechanism carried by said frame, said self-blocking mechanism comprising:

a brake movable between a braking position wherein said brake extends within said channel for frictionally engaging the lifeline and an enabling position wherein said brake clears said channel for clearing said the lifeline; and a fall arrest actuator distinct from said brake and connected to said brake, said fall arrest actuator being movable with respect to said frame in a direction transversal to said channel between a fall position wherein said fall arrest actuator forces said brake towards said braking position and an idle position wherein said fall arrest actuator does not force said brake towards said braking position.

DETAILED DESCRIPTION OF THE EMBODIMENTS

Figure 1:
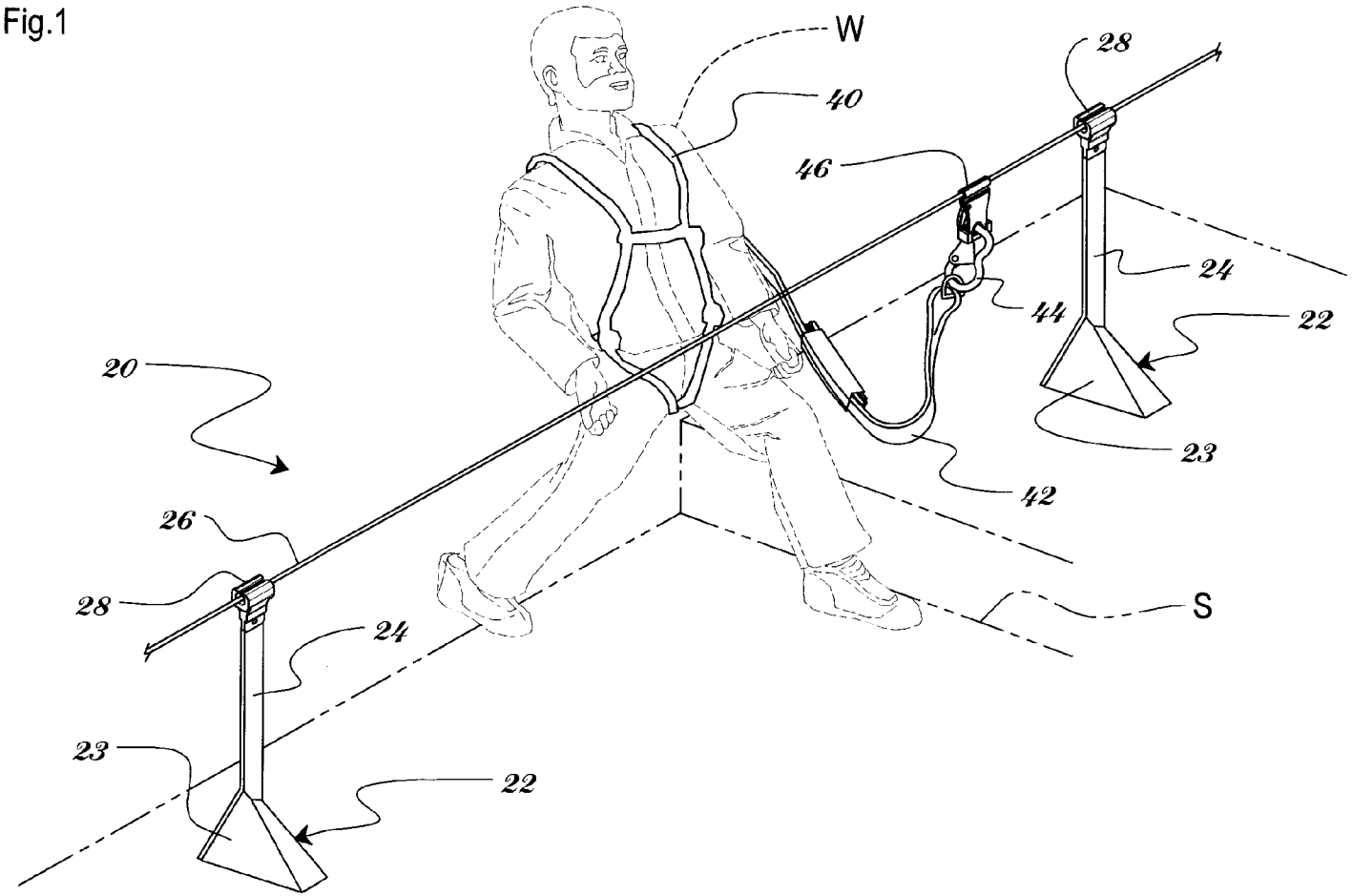
FIG. 1 is a perspective view of a fall arrest system with a worker attached to it, showing a segment of a lifeline of the fall arrest system and two lifeline supports, together with a trolley according to the present invention that attaches the worker's lanyard and carabiner to the lifeline.

FIG. 1 shows a fall arrest system 20 that comprises a number of spaced-apart supports 22, 22 that carry a lifeline 26. Lifeline 26 is anchored at both its extremities (not shown). Lifeline 26 may be flexible, such as a cable or wire as suggested in the drawings; or rigid, such as a rail. As suggested in FIG. 1, two successive supports 22, 22 may be vertically offset, resulting in lifeline 26 being inclined.

Figure 2:
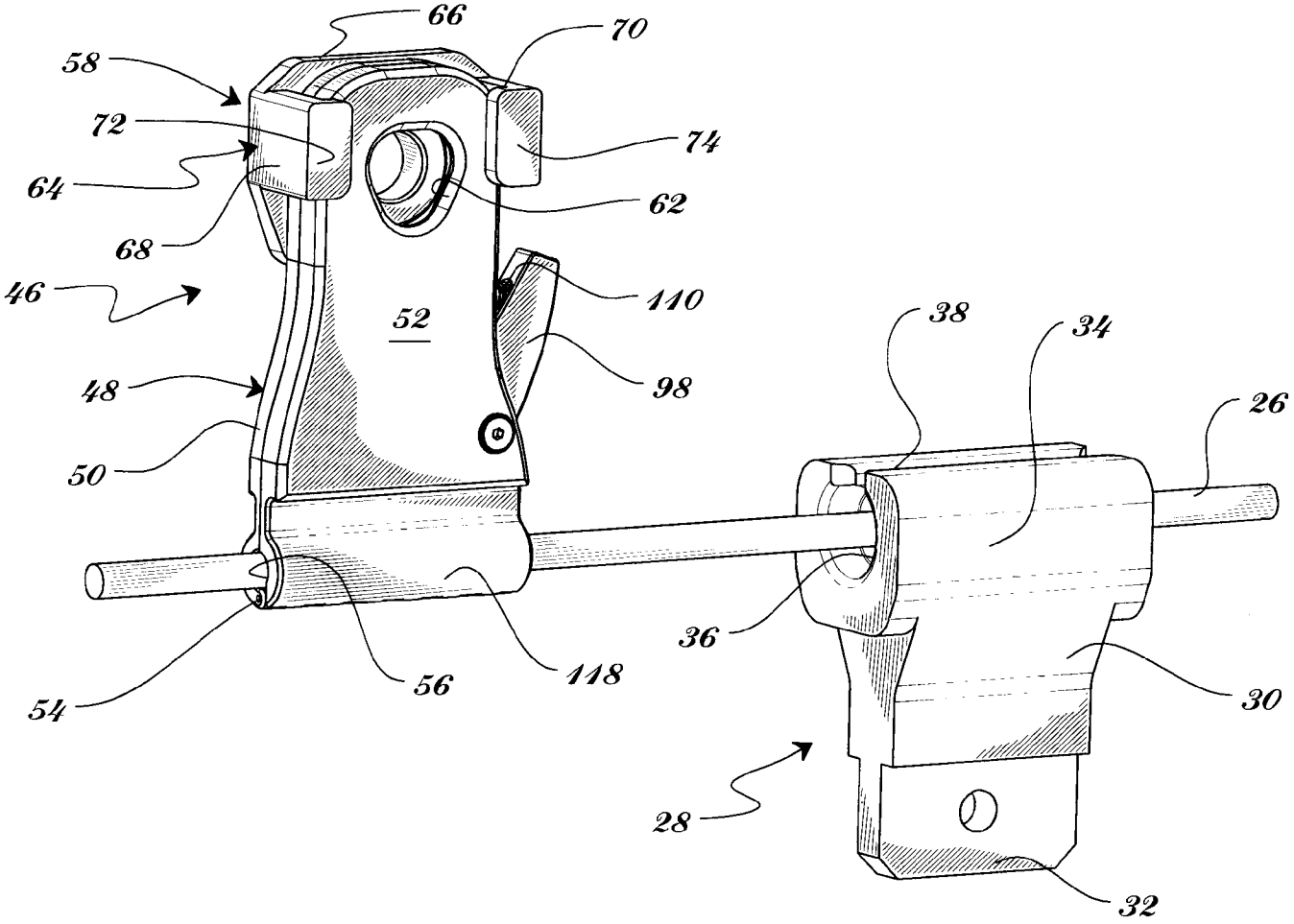
FIG. 2 is an enlarged perspective view of a lifeline segment of the fall arrest system of FIG. 1 together with a trolley and a lifeline support bracket.
Figure 3:
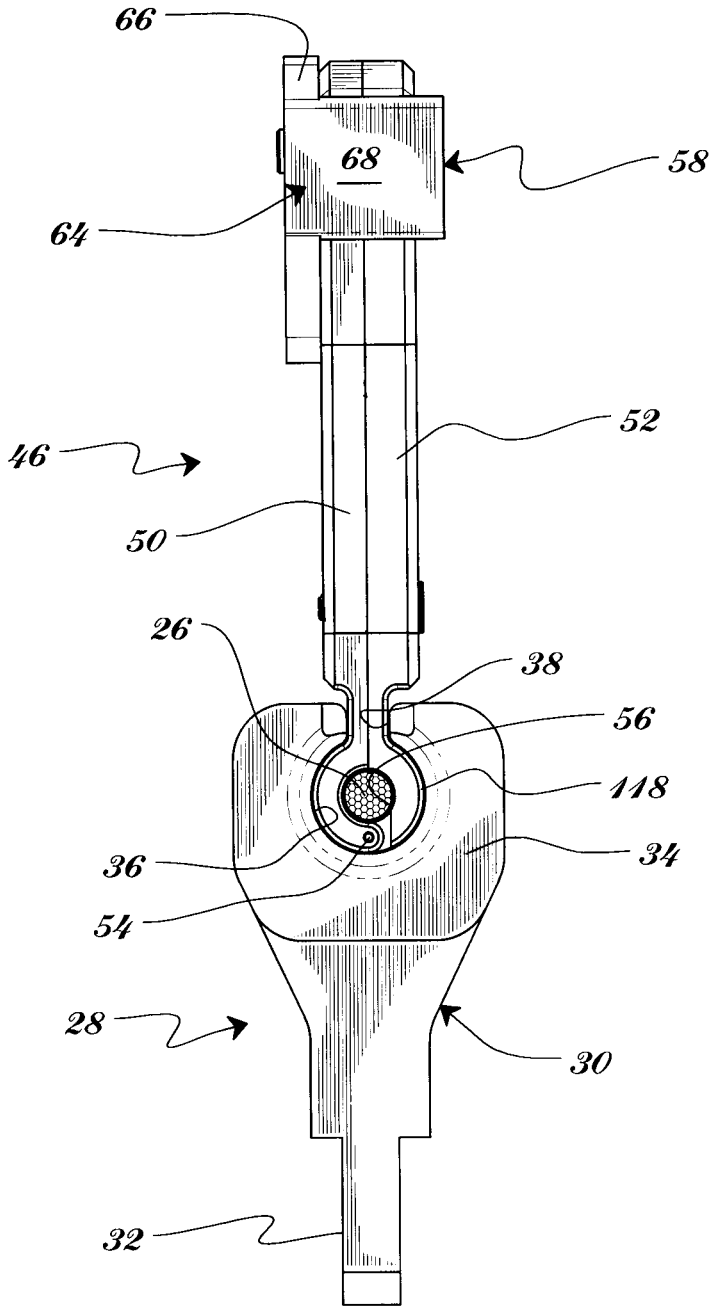
FIG. 3 is a cross-sectional view of the lifeline of FIG. 1 and an end view of the trolley engaging the lifeline support bracket.
Figure 4:
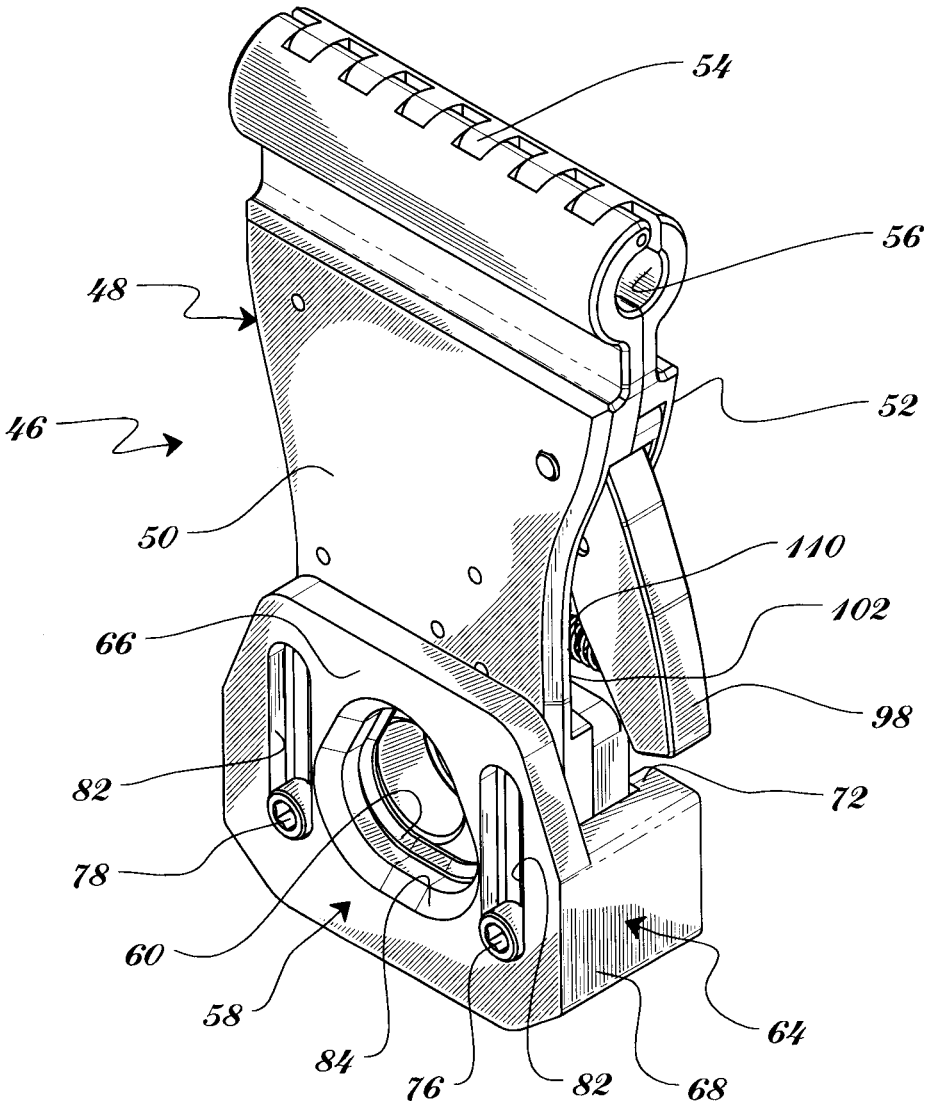
FIG. 4 is an enlarged perspective view of the trolley of FIG. 1, taken from a reverse angle with respect to FIGS. 1 and 2.

Supports 22 each comprise a base 23 attached to a structure S, a post 24 extending away from base 23 and a lifeline bracket 28 atop post 24. FIGS. 1-3 show that each support bracket 28 defines a main body 30 having a lower attachment end 32 for attachment to post 24 and a sleeve 34 for loosely receiving lifeline 26 therein opposite attachment end 32. Sleeve 34 more particularly defines a channel 36 that extends therethrough, and a slot 38 at its upper end. Lifeline 26 extends through channel 36. Slot 38 is narrower than the diameter of lifeline 26 to prevent egress of lifeline from channel 36. Supports 22 could alternately have any other suitable configuration to carry lifeline 26.

Lifeline 26 spacedly runs along structure S to allow a worker W to safely move along structure S in that if worker W falls, he will remain attached to lifeline 26. To this end, worker W is equipped with a harness 40 that worker W wears. A lanyard 42 is attached at one end to harness 40 and at the other end to a carabiner 44. Carabiner 44 is in turn attached to a trolley 46 that will itself be attached to lifeline 26.

Figure 5:
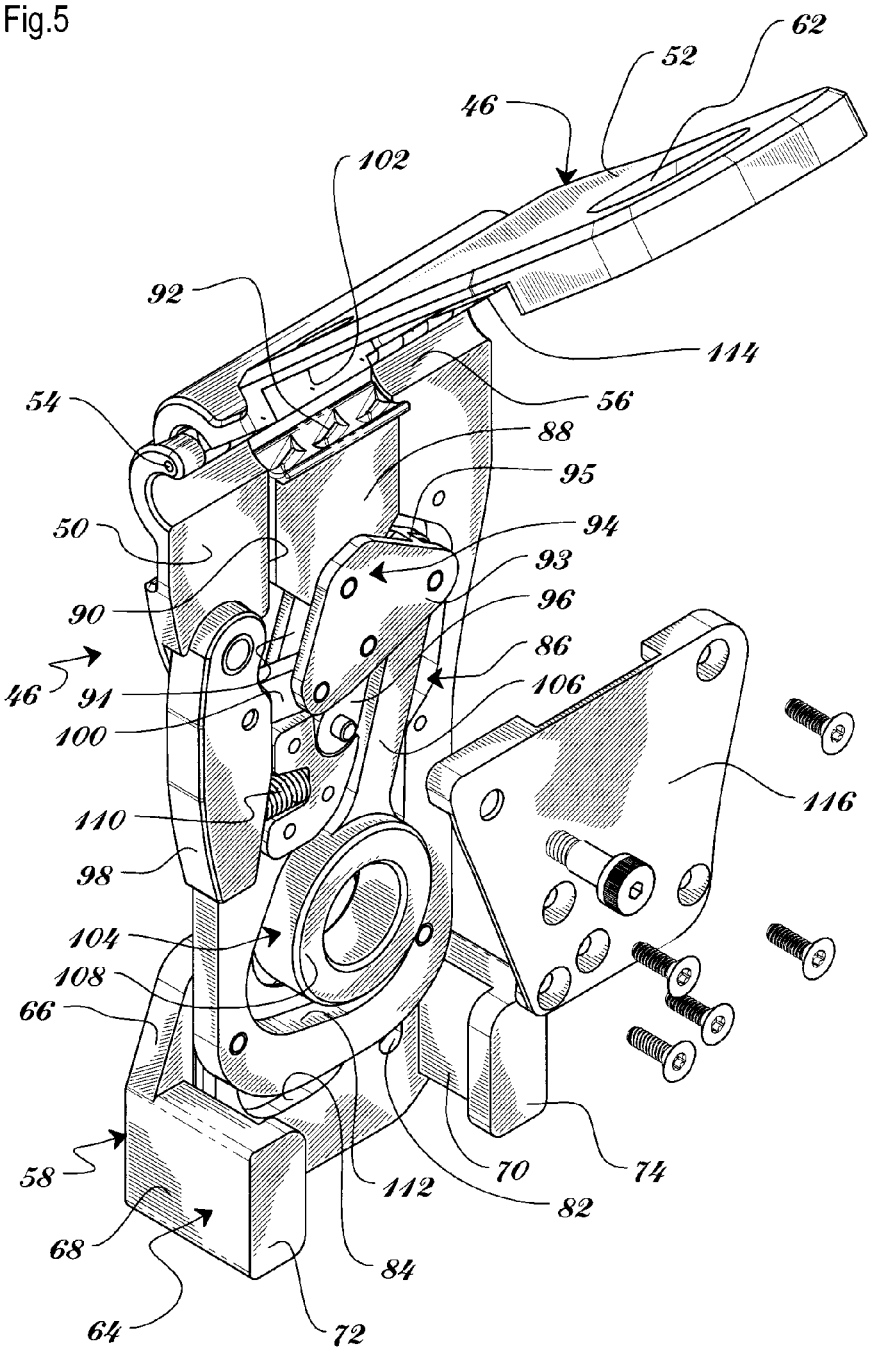
FIG. 5 is a perspective view of the trolley of FIG. 1, with its frame in an open position.

FIGS. 1-7 show that trolley 46 comprises a frame 48 formed of first and second frame portions 50, 52 movable with respect to each other between an opened position shown in FIG. 5 and a closed position shown in FIGS. 1-4. More particularly, first and second frame portions 50, 52 are pivotable about a hinge 54 between the opened position in which first and second portions 50, 52 are spread apart and the closed position in which first and second portions 50, 52 rest flatly against each other. A lifeline channel 56 extends through frame 48 near hinge 54. In the opened position of frame 48, transversal access to channel 56 is allowed for receiving lifeline 26 therein. In the closed position of frame 48, transversal access to channel 56 is not allowed, thereby preventing access or egress of lifeline 26 to or from channel 56, depending on whether lifeline 26 is already inserted in channel 56 or not. With frame 48 in its closed position and lifeline 26 in channel 56, trolley 46 may slide along lifeline 26 while remaining engaged thereon. This will be further detailed hereinafter.

Trolley 46 further comprises a lock generally referred to with number 58 capable of locking frame first and second portions 50, 52 in their closed position. Lock 58 comprises a pair of openings 60, 62 respectively formed in the frame first and second portions 50, 52. In the closed position of frame 48, openings 60, 62 are coextensive and collectively form a carabiner opening for allowing carabiner 44 to extend around frame first and second portions 50, 52 and through carabiner opening 60, 62 thereby locking frame first and second portions 50, 52.

Lock 58 further comprises a generally U-shaped locking clip 64 carried by frame 48 that comprises a substantially flat main body 66 from opposite extremities of which extends a pair of side arms 68, 70 that each have inwardly oriented retaining edges 72, 74. Main body 66 is mounted to an outer surface of frame first portion 50 by means of a pair of guide screws 76, 78 that are fixed to and protrude from frame first portion 50. These screws 76, 78 engage respective slots 80, 82 in main body 66 to allow locking clip 64 to remain attached to frame first portion 50 while being movable, and more particularly slidable, between locked and unlocked positions. In the locked position of locking clip 64 shown in FIGS. 1-4, locking clip 64 is moved in the direction of channel 56 until screws 76, 78 abut at one end of slots 80, 82: retaining edges 72, 74 then engage an outer surface of frame second portion 52 and locking clip 64 thus maintains frame first and second portions 50, 52 in their closed position. In the unlocked position of locking clip 64 shown in FIG. 5, locking clip 54 is moved in a direction away from channel 56 until screws 76, 78 abut at the other end of slots 80, 82: retaining edges 72, 74 then extend beyond the top edge of frame second portion 52, allowing frame 48 to be opened.

Locking clip 64 comprises an additional carabiner opening 84 formed in main body 66 for releasable engagement therein of carabiner 44 when locking clip 64 is in its locked position. Carabiner 44 will then extend concurrently through the first-mentioned carabiner opening 60, 62 in frame 48 and in additional carabiner opening 84 in locking clip 64 for preventing movement of locking clip 64 from its locked position to its unlocked position.

Frame 48 is more precisely in the form of a generally closed casing, although it is understood that an at least partly opened frame could alternately be envisioned. Having a generally closed casing is convenient to protect at least some inner elements of trolley 46.

Figure 6:
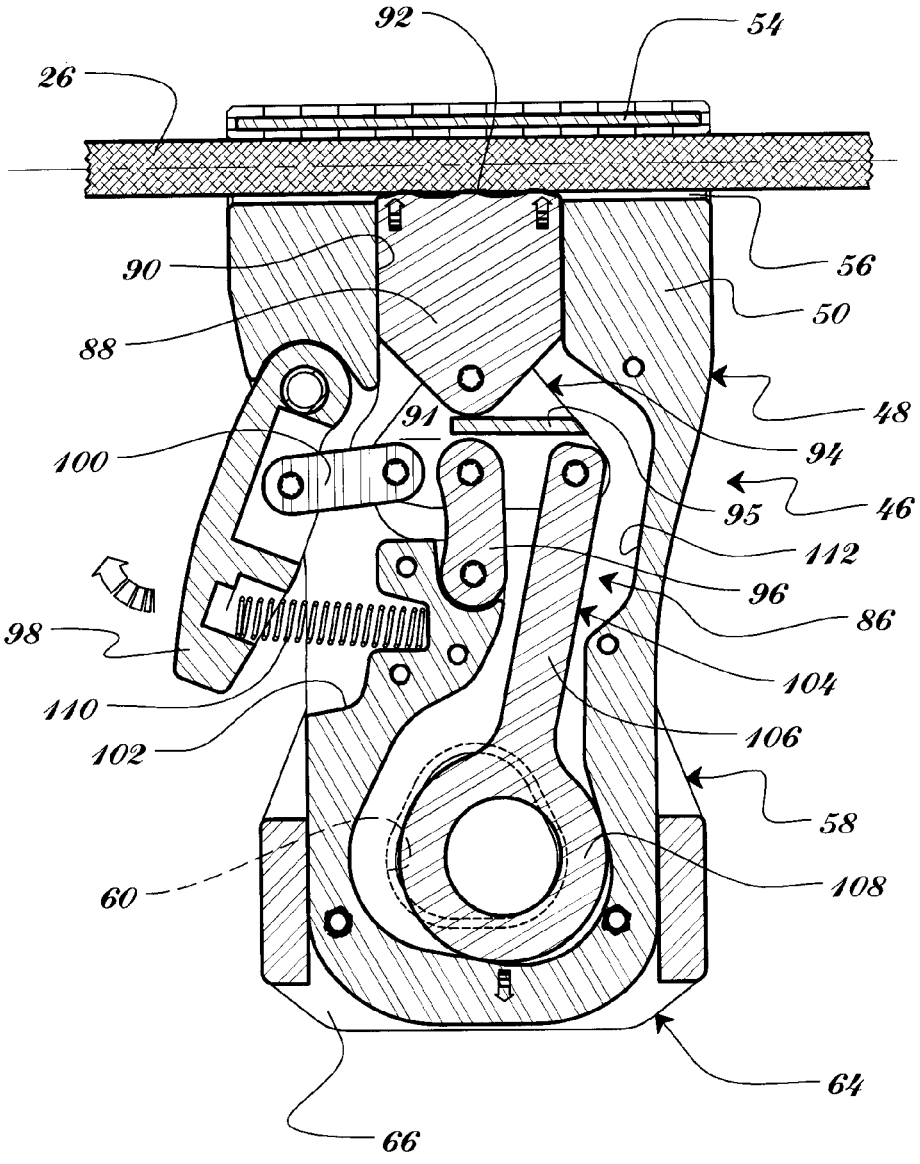
FIGS. 6 and 7 are cross-sectional side elevations of the trolley of FIG. 1 and a short segment of the lifeline extending through the trolley, with FIG. 6 showing the piston in its braking position, the actuating arm in its fall position and the trigger in its released position; and with FIG. 7 showing the piston in its enabling position, the actuating arm in its idle position and the trigger in its triggered position.
Figure 7:
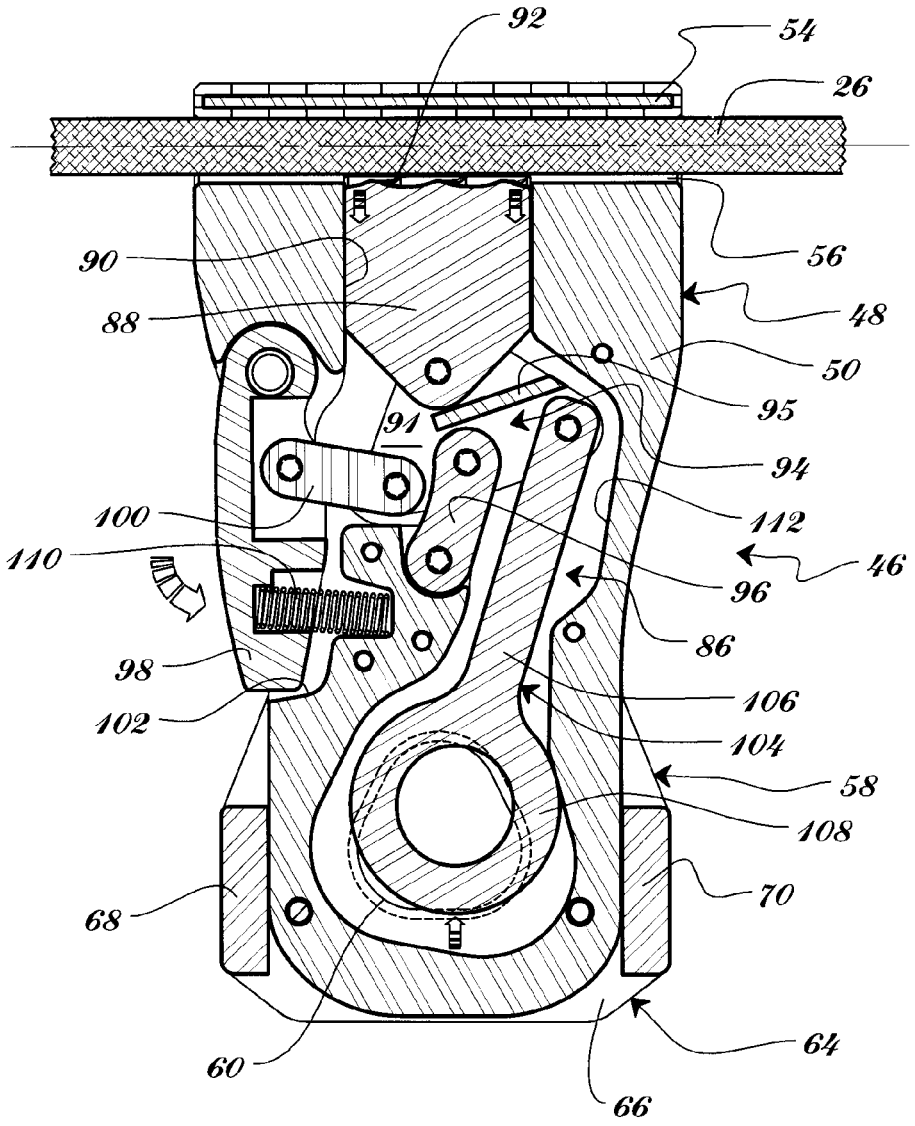

Frame 48 carries, and encloses when it is in its closed position, a self-blocking mechanism 86. FIGS. 5-7 show that self-blocking mechanism 86 comprises a brake in the form of a piston 88 movable between a braking position wherein piston 88 extends within channel 56 for frictionally engaging lifeline 26; and an enabling position wherein piston 88 clears channel 56 for clearing lifeline 26. Piston 88 is slidable in translation along a piston channel 90 formed in the casing first and second portions 50, 52 when they are in their closed position. Piston 88 comprises a serrated outer free edge 92 that can engage lifeline 26 with enhanced gripping action to prevent sliding of piston edge 92 in translation along lifeline 26.

Self-blocking mechanism 86 also comprises a cam 94 that is pivotally attached to a first link 96 which is in turn pivotally attached to the frame first portion 50. Cam 94 comprises a pair of parallel, spaced-apart plates 91, 93 fixedly attached to each other by means of an intermediate web 95.

Self-blocking mechanism 86 further comprises a manually operable enabling actuator that comprises a trigger 98 that is pivotally carried by frame first portion 50. Trigger 98 is further pivotally connected to cam 94 by means of a second link 100. By its connection to cam 94, trigger 98 is consequently connected to piston 88 and capable of forcing piston 88 towards its enabling position. More particularly, trigger 98 is movable between a released position shown in FIGS. 2, 4 and 6 wherein trigger 98 extends outside of frame 48 through a lateral opening 102; and a triggered position shown in FIGS. 5 and 7 wherein trigger 98 is pivoted at least partly into frame 48 through opening 102. The linkage comprised of second link 100, cam 94 and first link 96 allows the pivotal movement of trigger 98 between its released and triggered positions to result in a corresponding translational movement of piston 88 respectively between its braking and enabling positions. By manually pressing trigger 98 into its triggered position, piston 88 is consequently forced into its enabling position.

Self-blocking mechanism 86 further comprises a fall arrest actuator that comprises an actuating arm 104 that comprises a rod 106 pivotally connected at a first end to cam 94. Actuating arm 104 also comprises a user connector in the form of a ring 108 provided at a second end of rod 106, opposite its connection to cam 94. Actuating arm 104 is movable with respect to frame 48 between a fall position shown in FIGS. 2, 4 and 6 wherein it is moved away from channel 56; and an idle position shown in FIGS. 5 and 7 wherein it is moved in the direction of channel 56. The linkage comprised of cam 94 and first link 96 allows the movement of actuating arm 104 between its fall and idle positions to result in a corresponding translational movement of piston 88 respectively between its braking and enabling positions.

It is noted that the movement of actuating arm 104 between its fall and idle positions occurs at least partly in translation: while the end of rod 106 connected to cam 94 will both pivot and translate as a result of the pivotal movement of cam 94 about its connection to first link 96, ring 108 will mostly translate as a result of this movement.

The relative distances between (a) the pivotal attachments of second link 100 and first link 96 to cam 94 and (b) the pivotal attachments of actuating arm 104 and first link 96 to cam 94, contribute to allow actuating arm 104 to be capable of overriding trigger 98 to force piston 88 towards its braking position, and even favors this override, if sufficient force is exerted on actuating arm 108 compared to that exerted on trigger 98 of course. That is to say, the leverage action by actuating arm 104 on cam 94 is greater than the leverage action by trigger on cam 94 via second link 100.

Self-blocking mechanism 86 further comprises a biasing member in the form of a spring 110 tensioned between trigger 98 and frame 48. Through the linkage comprised of trigger 98, second link 100 and cam 94, spring 110 continuously biases piston 88 towards its braking position. However, should sufficient force be exerted on trigger 98, the latter would be capable of overriding spring 110 to force piston 88 towards its enabling position.

As mentioned above, frame first and second portions 50, 52 are shaped as a casing. They are further machined on their inner surface to have a respective inner cavity 112, 114 that collectively form an inner chamber 112, 114 in frame 48 when it is in its closed position. This inner chamber includes the piston channel 90 and the trigger opening 102, but to further accommodates the entire self-blocking mechanism 86 within frame 48.

Actuating arm ring 108 is accessible outside of frame 48 since it extends within carabiner opening 60, 62 formed in frame 48.

A protective cover 116 (FIG. 5) is fixed to frame first portion 50 within inner chamber 112, 114 to protect some elements of self-blocking mechanism 86 when frame 48 is in its opened position. Cover 116 will indeed cover cam 94, first and second links 96, 100 and part of actuating arm rod 106, spring 110, trigger 98 and piston 88.

In use, when worker W wishes to attach himself to lifeline 26, trolley 46 is first handled by moving locking clip 64 towards its unlocked position, allowing frame 48 to be opened as in FIG. 5 by pivoting the frame first and second portions 50, 52 away from each other. Transversal access to channel 56 is thereby allowed so that lifeline 26 may be inserted into channel 56. Before lifeline is inserted into channel 56, trigger 98 must be manually forced towards its triggered position as also shown in FIG. 5, to force piston 88 into its enabling position wherein it clears channel 56 to allow lifeline 26 to be properly inserted therein. At any time after lifeline 26 is properly inserted in channel 56, trigger 98 is released with spring 110 forcing piston 88 to engage lifeline 26 with its serrated edge 92 once trigger 98 is released. Frame 48 is then closed by applying first and second frame portions 50, 52 against each other. Locking clip 64 is moved into its locked position as in FIGS. 2-4 and 6-7. At this point, trolley is secured to lifeline 26 and, once trigger 98 is released, trolley 46 is prevented from moving along lifeline 26 due to the frictional engagement of piston 88 against lifeline 26.

Worker W, equipped with his harness 40, lanyard 42 and carabiner 44, will then attach his carabiner 44 and lanyard to trolley 46 by opening the spring catch of carabiner 44 and inserting carabiner 44 concurrently through the carabiner opening 60, 62 of first and second frame portions 50, 52, through the additional carabiner opening 84 of locking clip 64 and through ring 108 of actuating arm 104. The carabiner's spring catch is then released, thereby securing the user to trolley 46 and consequently to lifeline 26. Also, as noted above, by inserting carabiner 44 concurrently through carabiner opening 60, 62 and locking clip additional carabiner opening 84, trolley frame 48 is effectively locked in its closed position by preventing locking clip 64 from moving into its unlocked position.

Due to the continuous biasing action of spring 110, piston 88 will by default be forced into its braking position when no other exterior force is exerted on self-blocking mechanism 86. This prevents trolley 46 from moving along lifeline 26 since piston 88 will frictionally engage lifeline 26 and will be forced thereagainst by the action of spring 110. Worker W may then move about trolley 46 only as allowed by the length of his lanyard 42. Due to the fact that all of trigger 98 (thought second link 100), actuating arm 104 and piston 98 are linked to cam 84, the bias of spring 110 against trigger 98 will also result in actuating arm 104 being forced towards its fall position, although this is incidental and has no consequence in itself under normal circumstances when worker W does not fall.

If worker W wishes to move trolley 46 to another position along lifeline 26, he is required to positively act by manually forcing trigger 98 into its triggered position against the bias of spring 110, which will force piston 88 into its enabling position. With piston 88 not engaging lifeline 26 anymore, worker W may then move trolley 46 along lifeline 26. Due to the fact that all of trigger 98 (thought second link 100), actuating arm 104 and piston 98 are linked to cam 84, forcing trigger 98 into its triggered position will also result in actuating arm 104 being forced towards its idle position, although this is incidental and has no consequence in itself.

If worker W falls from the structure S on which he is moving, his attachment to lifeline 26 will prevent him from falling beyond the length of lanyard 42. He will in fact become suspended by lanyard 42 under lifeline 26. Trolley 46, which may rotate about lifeline 26 against the frictional engagement of piston 88 on lifeline 26, will be forced to turn until it is oriented downwards, i.e. with its channel 56 located above its actuating arm ring 108, under the pulling action of the worker's weight onto carabiner 44 that engages the carabiner openings 60, 62, 84 and the actuating arm ring 108. This will effectively arrest the fall of worker W and will prevent that the worker fall to the ground, instead limiting the fall to the length of lanyard 42.

The fall of worker W will further pull on ring 108 of actuating arm 104 to force actuating arm 104 towards its fall position. This will in turn force piston 88 into its braking position. In the case where lifeline 26 is inclined or sags under the worker's weight, the braking action of piston 88 will prevent that trolley 46 slide along the sloping lifeline 26 preventing, among other undesirable consequences, a collision between the sliding user and elements of structure S. In this respect, the fall of the worker will further be arrested by trolley 46.

As suggested above, the weight of worker W acting to pull actuating arm 104 towards its fall position is capable of overriding a gripping action of worker W on trigger 98. That is to say, even if worker W was holding trigger 98 in its triggered position when the fall occurs, thereby maintaining piston 88 in its enabling position and actuating arm in its idle position, the force exerted by actuating arm 104 on cam 94 will be greater than the force exerted by trigger 98 on cam 94 (through second link 100), consequently forcing piston 88 into its braking position. This override is enabled by the fall arrest actuator (namely actuating arm 104), being distinct from the brake (namely piston 88) and from the enabling actuator (namely trigger 98): indeed, worker W will not be handling the actuating arm in any way, so he may not force the actuating arm itself away from its fall position. If worker W were to manually pull on the fall arrest actuator itself or on the brake itself to enable movement of the trolley along the lifeline, like in prior art devices, this gripping action could prevent the fall arrest actuator and brake to act as intended. The present invention consequently avoids this problem.

An advantage of the present invention relies on actuating arm 104 being movable with respect to frame 48 in a direction transversal to channel 56 between its idle and fall positions. This means that although the trolley 46 and worker W may move in a direction parallel to the lifeline under normal circumstances, if the user falls in a direction that is transversal to the lifeline 46, the fall arrest actuator will be activated and piston 88 will be forced towards its braking position. This differs from the prior art wherein, both in the cases of trolleys used on vertical lifelines and on inclined lifelines, the fall arrest actuators were intended to be activated only when the user fell in a direction parallel to the lifeline and consequently the lanyard pulled on the fall arrest actuator in a direction parallel to the lifeline.

It is noted that the above-mentioned transversal direction of the pull that enables the activation of the fall arrest actuator of the present invention, need not be perpendicular. It could in fact be angled in one direction or another with respect to the perpendicular direction. In fact, in practice, it is likely that the fall arrest actuator will be useful in any fall that occurs transversely to an inclined lifeline 26 but not perpendicularly: if the fall were to occur perpendicularly, this would mean that the lifeline is horizontal, in which case the user will not slide along lifeline 26, unless it sags—but then, the fall may not be perpendicular anymore once the lifeline sags.

On this topic, it is noted that the shape of the frame carabiner opening 60, 62 and that of the locking clip additional carabiner opening 84 are generally triangular, allowing some leeway for limited lateral displacement of the carabiner and of the actuating arm ring 108 with respect to frame 48. Actuating arm ring 108 will be carried to one side or the other should the user fall along an inclined segment of lifeline 26, but it remains the pull transversely away from lifeline 26 that will force the piston into its braking position. It is consequently noted that although the fall of the user, and the pull on trolley 46, may be in one transversal direction relative to the lifeline 26, the important consequential action remains the movement of actuating arm 104 that will also be transversal to lifeline 26 albeit not necessarily at the same angle. This transversal movement of actuating arm 104 may be perpendicular, or not. And this transversal movement may be include both a translational and a pivotal movement as is the case in the embodiment shown in the drawings; or alternately it may be the tangent of an exclusively pivotal movement or it may be entirely translational with only slight modifications to the design of the trolley.

The direction of the displacement of actuating arm may be referenced herein with respect to lifeline 26 or with respect to lifeline channel 56—in the latter case to refer to a structure of trolley 46 itself.

On another topic, with reference to FIGS. 1-3, it is noted that the lifeline bracket 28 will preferably have a means to allow the trolley to be oriented downwards even when trolley 46 passes through a lifeline support bracket 28. Indeed, in the embodiment shown in FIGS. 1-3, when passing through bracket 28, trolley 46 will have to be oriented upwards as shown in FIGS. 2-3, to allow the trolley frame portion 118 about channel 56 to pass through the bracket channel 36 while the rest of trolley 46 will extend through and beyond bracket slot 38. This arrangement allows the bracket 28 to retain lifeline 26 while still allowing trolley 46 to pass. However, according to the above description of the use of trolley 46 within fall arrest system 20, trolley 46 will have to pivot downwardly about lifeline 26 when a user falls for its fall arrest actuator to be activated, i.e. for its actuating arm 104 to be pulled by the weight of the falling worker. While this is not problematic at any position along lifeline 26 between two brackets 28, this poses a challenge at the position of brackets 28. To enable fall arrest system 20 to be functional also at the positions of brackets 28, each bracket 28 can have breakable or detachable side walls on its sleeve 34 that will break if sufficient sideward force is applied. The resistance of the breakable walls of sleeve 34 should be calibrated to allow the cable to be retained in case of a fall, and the walls to yield if the trolley 46 engages sleeve 34 and a user falls. Another option would be to offer inclined surfaces in bracket channel 36 such that the trolley would slide and be expelled out of bracket 28 should a user fall. Yet another option would be to have the bracket 28 oriented upside down with its slot 38 oriented downwards and either its base 22 attached to an upper structure or its base still attached to a lower structure but its post curving to allow the downward orientation of the slot 38. Any of the above designs of bracket 38 would allow trolley 46 to be functional not only along the length of lifeline 26 between supports 22, but even when it engages one of the brackets 28.

The invention claimed is:

1. A trolley for use in a fall arrest system, said trolley comprising a frame, a channel formed within said frame for engagement therein of a lifeline, and a self-blocking mechanism carried by said frame, said self-blocking mechanism comprising:

a brake movable between a braking position wherein said brake extends within said channel for frictionally engaging the lifeline; and an enabling position wherein said brake clears said channel for clearing the lifeline;

a manually operable enabling actuator connected to said brake and capable of forcing said brake towards said enabling position;

a fall arrest actuator distinct from said brake and from said enabling actuator, and connected to said brake, said fall arrest actuator being movable with respect to said frame between a fall position wherein said fall arrest actuator forces said brake towards said braking position and an idle position wherein said fall arrest actuator does not force said brake towards said braking position, with said fall arrest actuator capable of overriding said enabling actuator to force said brake towards said braking position;

a biasing member continuously biasing said brake towards said braking position, said enabling actuator cat able of overriding said biasing member to force said brake towards said enabling position; and a cam pivotally carried by said frame, with said brake, said enabling actuator, and said fall arrest actuator all pivotally attached to said cam.

2. A trolley as defined in claim 1, wherein said fall arrest actuator is movable with respect to said frame in a direction transversal to said channel between said fall position that is located away from said channel and said idle position that is located towards said channel.

3. A trolley as defined in claim 1, wherein said biasing member comprises a spring tensioned between said enabling actuator and said frame, with said spring continuously biasing said brake towards said braking position through the instrumentality of said enabling actuator.

4. A trolley as defined in claim 2, wherein said fall arrest actuator is movable with respect to said frame in a direction perpendicular to said channel between said fall position that is located away from said channel and said idle position that is located towards said channel.

5. A trolley as defined in claim 1, wherein said brake comprises a piston movable in translation within said frame between said braking and enabling positions.

6. A trolley as defined in claim 1, wherein said enabling actuator comprises a trigger pivotally carried by said frame and pivotally linked to said cam.

7. A trolley as defined in claim 1, wherein said fall arrest actuator comprises an actuating arm pivotally attached to said cam at a first end and comprising a user connector at a second end for attachment to a user carabiner and lanyard, said actuating arm being movable at least partly in translation with respect to said frame between said fall and idle positions.

8. A trolley as defined in claim 7, wherein said user connector comprises a ring for attachment to the carabiner and lanyard, with said frame comprising a carabiner opening wherein said ring is located for allowing the carabiner to concurrently engage said actuating arm ring and said carabiner opening.

9. A trolley as defined in claim 8, wherein said frame comprises first and second frame portions movable with respect to each other between an opened position wherein transversal access to said channel is allowed for allowing access and egress of the lifeline therein, and a closed position wherein transversal access to said channel is not allowed for preventing access or egress of the lifeline to or from said channel.

10. A trolley as defined in claim 9, wherein said enabling actuator comprises a trigger pivotally carried by said frame and pivotally linked to said cam, with said frame comprising a casing generally enclosing said self-blocking mechanism, with said channel extending through said casing, with said user connector being accessible outside of said casing and with said trigger being pivotally connected to said casing within said casing and extending outside of said casing.

11. A trolley as defined in claim 9, further comprising a lock capable of locking said frame first and second portions in their closed position, said lock comprising said carabiner opening that extends through both said frame first and second portions for allowing the carabiner to extend around said frame first and second portions and through said carabiner opening thereby locking said frame first and second portions.

12. A trolley as defined in claim 11, wherein said lock further comprises a locking clip carried by said frame and movable between a locked position wherein said locking clip maintains said frame first and second portions in said closed position and an unlocked position wherein said locking clip releases said frame first and second portions.

13. A trolley as defined in claim 12, wherein said locking clip comprises an additional carabiner opening for releasable engagement therein of the earabiner when said locking clip is in said locked position for preventing movement of said locking clip from said locked position to said unlocked position.

14. A trolley for use in a fall arrest system, said trolley comprising a frame, a channel formed within said frame for engagement therein of a lifeline, and a self-blocking mechanism carried by said frame, said self-blocking mechanism comprising:

a brake movable between a braking position wherein said brake extends within said channel for frictionally engaging the lifeline and an enabling position wherein said brake clears said channel for clearing the lifeline; and a fall arrest actuator distinct from said brake and connected to said brake, said fall arrest actuator being movable with respect to said frame in a direction transversal to said channel between a fall position wherein said fall arrest actuator forces said brake towards said braking position and an idle position wherein said fall arrest actuator does not force said brake towards said braking position, wherein said fall arrest actuator is movable in said transversal direction away from said channel when it moves towards said fall position, and towards said channel when it moves towards said idle position; and a cam pivotally carried by said frame, with said brake and said fall arrest actuator both pivotally attached to said cam.

15. A trolley as defined in claim 14, wherein said brake comprises a piston movable in translation within said frame between said braking and enabling positions.

16. A trolley as defined in claim 14, wherein said fall arrest actuator comprises an actuating arm pivotally attached to said cam at a first end and comprising a user connector at a second end for attachment to a carabiner and lanyard, said actuating arm being movable at least partly in translation with respect to said frame between said fall and idle positions.

17. A trolley as defined in claim 16, wherein said user connector comprises a ring for attachment to a user carabiner and lanyard, with said frame comprising a carabiner opening and with said ring located within said carabiner opening for allowing the carabiner to concurrently engage said actuating arm ring and said carabiner opening.

18. A trolley as defined in claim 16, further comprising a manually operable enabling actuator connected to said brake and capable of forcing said brake towards said enabling position, with said fall arrest actuator capable of overriding said enabling actuator to force said brake towards said braking position.

19. A trolley as defined in claim 18, wherein said self-blocking mechanism comprises a biasing member continuously biasing said brake towards said braking position, said enabling actuator capable of overriding said biasing member to force said brake towards said enabling position.

20. A trolley as defined in claim 19, wherein said biasing member comprises a spring tensioned between said enabling actuator and said frame, with said spring continuously biasing said brake towards said braking position through the instrumentality of said enabling actuator.

21. A trolley as defined in claim 20, wherein said enabling actuator comprises a trigger pivotally carried by said frame and pivotally linked to said cam.

22. A trolley as defined in claim 16, wherein said frame comprises first and second frame portions movable with respect to each other between an opened position wherein transversal access to said channel is allowed for allowing access and egress of the lifeline therein, and a closed position wherein transversal access to said channel is not allowed for preventing access or egress of the lifeline therein.

23. A trolley as defined in claim 22, wherein said enabling actuator comprises a trigger pivotally carried by said frame and pivotally linked to said cam, with said frame comprising a casing generally enclosing said self-blocking mechanism, with said channel extending through said casing, with said user connector being accessible outside of said casing and with said trigger being pivotally carried by said casing within said casing and extending outside of said casing.

24. A trolley as defined in claim 23, further comprising a lock capable of locking said frame first and second portions in their closed position, said lock comprising said carabiner opening that extends through both said frame first and second portions for allowing the carabiner to extend around said frame first and second portions and through said carabiner opening thereby locking said frame first and second portions.

25. A trolley as defined in claim 24, wherein said lock further comprises a locking clip carried by said frame and movable between a locked position wherein said locking clip maintains said frame first and second portions in said closed position and an unlocked position wherein said locking clip releases said frame first and second portions.

26. A trolley as defined in claim 25, wherein said locking clip comprises an additional carabiner opening for releasable engagement therein of the carabiner when said locking clip is in said locked position for preventing movement of said locking clip from said locked position to said unlocked position.

* * * * *